United States Patent [19]

Bernhardt et al.

[11] Patent Number: 4,723,343

[45] Date of Patent: Feb. 9, 1988

[54] METHOD AND APPARATUS OF CARDING

[76] Inventors: Siegfried Bernhardt, Hasenkuhle 2, 2820 Bremen 71; Hans Schmiedgen, Korbweide 15; Dietrich Menzel, Gutsmeierweg 22, both of 2820 Bremen 70; Dieter Müller, Eibenstr. 1, 2807 Achim, all of Fed. Rep. of Germany

[21] Appl. No.: 909,700

[22] Filed: Sep. 4, 1986

[30] Foreign Application Priority Data

Sep. 7, 1985 [DE] Fed. Rep. of Germany ..... 3532021

[51] Int. Cl.[4] ..... D04H 1/00; D01G 15/02

[52] U.S. Cl. ..... 19/98; 19/105; 19/106 R

[58] Field of Search ..... 19/98, 99, 105, 106 R

[56] References Cited

U.S. PATENT DOCUMENTS

| | | | |
|---|---|---|---|
| 1,087,130 | 2/1914 | McBride | 19/99 |
| 2,835,929 | 5/1958 | Taine et al. | 19/99 |
| 4,523,350 | 6/1985 | Schmiedgen et al. | 19/98 |
| 4,615,080 | 10/1986 | Wirth | 19/106 R |

*Primary Examiner*—Louis K. Rimrodt

*Attorney, Agent, or Firm*—Hill, Van Santen, Steadman & Simpson

[57] ABSTRACT

Method for the manufacture of formed fabric from fibrous material by means of a carder or the like, whereby the fibrous material is carded upon employment of at least two working rollers of the same diameter running in the same direction as one another, characterized in that the fibrous material is conducted over at least three working rollers residing in mutually adjustable engagement with one another, being conducted thereover under adjustable, partial return storing; also a carder for the implementation thereof.

7 Claims, 2 Drawing Figures

METHOD AND APPARATUS OF CARDING

Figure 1:
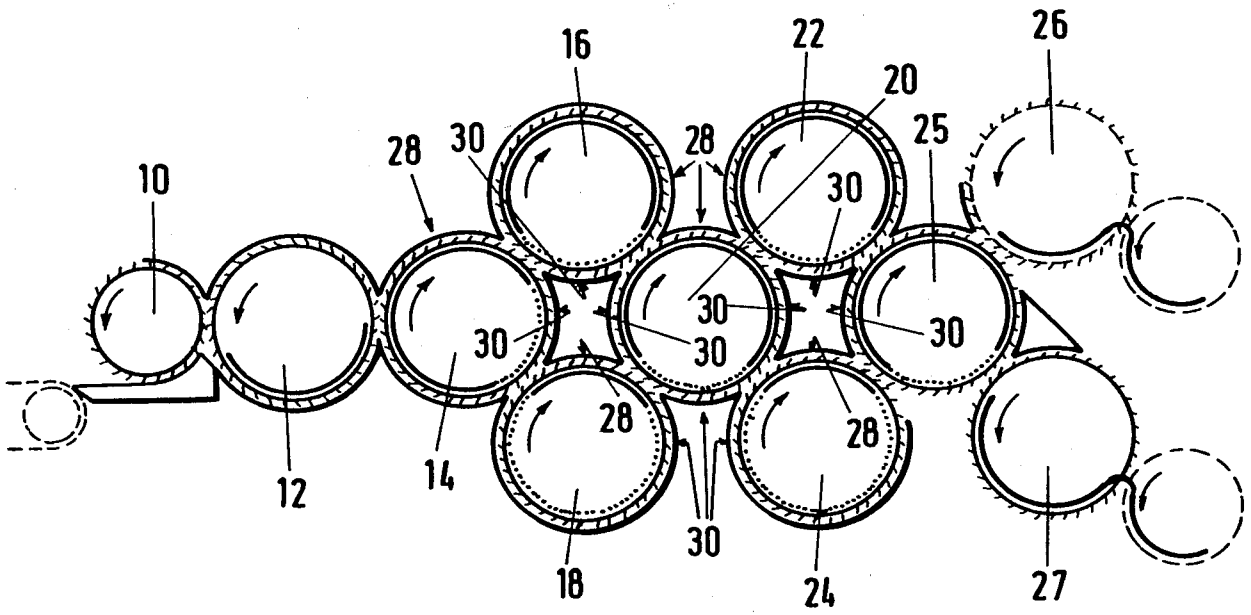

The invention relates to a method for the manufacture of formed fabrics from fibrous material by means of a carder or the like wherein the fibrous material is carded upon employment of at least two working rollers of the same diameter and running in the same direction as one another, and also relates to a carder for the manufacture of formed fabrics from fibrous material having at least one draw-in roller or the like, a licker-in running in the same direction having a drawing between 100 and 200, at least two working rollers of the same diameter following the licker-in and running in the same direction as one another whose speed is higher than that of the licker-in, as well as having at least one doffing cylinder allocated to the working rollers lying functionally farthest from the licker-in, this carder, in particular, being for the implementation of the above method.

German Utility Model No. 82 18 526 discloses a method as well as a carder of the species set forth above wherein the working rollers following the licker-in are fashioned as principal rollers which are respectively followed by a matting roller and, further, as is generally standard in carders of the species under consideration here, each of which has at least one pair of workers and clearers allocated to it. The worker-clearer rolls which comprise a smaller diameter than the principal or, respectively, matting roller(s) in a generally standard way in the apparatus of the species thereby serve the purpose of seeing to an adequate carding of the fibrous material, whereas the matting roller or rollers pursue the purpose of achieving an optimally great uniformity of the matted fleece structure over the full width of the formed fabric being manufactured, agreeing with the universally desirable goal of keeping the ratio of longitudinal strength to cross strength optimally within the range of 1:1 over the full extent of the formed fabric.

German Pat. No. 23 43 064 discloses a carder wherein, differing from the apparatus of the species, the working rollers respectively following one another run in opposite direction, whereby worker-clearer rolls of the type already set forth, having smaller diameter than the working rollers, are likewise provided. It is thereby disadvantageous that the individual working rollers must exhibit respectively increasing speed, so that the obtainable carding effect or, respectively, the number of possible working rollers arranged following one another is, of course, limited since, naturally, arbitrarily high speeds cannot be realized.

The method of the species as well as the appertaining carders have definitely proven themselves on principle. It has been shown, however, that, as a consequence of the generally observed tendency to continuously increase the working width of such carders, the employment of workers and clearers having a necessarily relatively small diameter in comparison to the principal rollers involves greater and greater difficulties since sags of the appertaining rollers are unavoidable, for example given working widths of 4 m or more. As a consequence of the numerous, different circumferential speeds of the rollers having different diameters, moreover, such as principal rollers, matting rolls as well as workers and clearers, the structural outlay is comparatively involved.

The object of the invention is to create a method as well as a carder in accord with the species wherein, given reduced structural outlay with high operating speeds, achieving higher working widths while guaranteeing an optimum uniformity of the matted fleece structure over the full fleece width is enabled.

In a method of the species initially cited, this object is achieved in accord with the invention in that the fibrous material is conducted over at least three working rollers residing in mutual, adjustable engagement with one another, being guided thereover under adjustable, partial return-storing.

A preferred embodiment of the method of the invention provides that the working rollers are driven with adjustable speed independently of one another.

For achieving the object set forth above, the inventive carder of the species is characterized in that two working rollers (respectively) cooperate with the licker-in and/or with a first working roller immediately following thereupon, a further working roller following said two working rollers in common.

It can thereby be provided that a second working roller and a third working roller cooperate with the first working roller immediately following the licker-in, a fourth working roller following said second and said third working roller in common.

Alternatively thereto, it can also be provided that the first working roller as well as a second working roller are in engagement with the licker-in, whereby the first and the second working roller as well as a potential third working roller collaborating with the first working roller cooperate in common with a fourth working roller.

The invention further provides, under given conditions, that the first working roller and the second working roller are in conformity with one another.

It can also be provided in accord with the invention that the fourth working roller is followed by a fifth and a sixth working roller which are followed by at least one further working roller and/or the doffing cylinder(s).

Under given conditions, the apparatus of the invention is further distinguished in that at least one of the working rollers interacts with respectively three other working rollers.

It can thereby be provided that at least one of the working rollers interacts with respectively four other working rollers.

Under given conditions, the invention further provides that the relative speeds and/or the mutual spacings of the working rollers are adjustable, being adjustable, first, for the control of that portion of the fibrous material return-storable onto the respective working roller and, second, for the control of the fibrous material transferrable onto the respectively following working rollers.

A further embodiment of the invention proposes that the working rollers are provided with sawtooth fittings or the like.

Finally, it can be provided in accord with the invention that the relative speeds of the working rollers do not exceed three times the circumferential speed.

It can be provided in the carder of the invention that the licker-in running in the same direction as the draw-in roll which, as known, can be preceded by a draw-in trough also runs in the same direction as the working rollers; however, licker-in and working rollers can also rotate in opposite directions.

The invention is based on the surprising perception that one succeeds in achieving the stated object in a simple way in that, given complete abandonment of the worker-clearer rollers hitherto considered indispensable, a satisfactory carding effect and uniformity of the formed fabric to be manufactured can be achieved over the full fleece width even given the greatest possible machine widths when a plurality of working rollers of the same diameter which interact in the claimed way are provided. In conjunction with the inventively proposed adjustability of the relative speeds as well as of the relative positions of the individual working rollers, a controllable return-storing possibility onto every individual working roller can thus be created given appropriate shaping of the surface structure, namely in the form of sawtooth fittings or the like, whereby, thus, a defined portion of the fibrous material can be returned on to the appertaining working roller as desired and subjected to renewed carding and the other portion is transferred onto the next, following working roller. Of course, not only four working rollers of the claimed type can be interconnected, as provided as the minimum number in accord with the invention, but, as constitutes the subject matter of the preferred embodiment set forth above, this group of four working rollers can be followed by two further working rollers or, under given conditions, can also be followed by further groups of four as well as by individual working rollers, etc., whereby all embodiments share the common features that the working rollers have the respectively same diameter and each has its own drive available, whereby, of course, a central drive is also conceivable as long as it is guaranteed that the individual working rollers, adjustable in terms of their mutual relative positions, can be respectively driven with controllable speed independently of one another.

Figure 2:
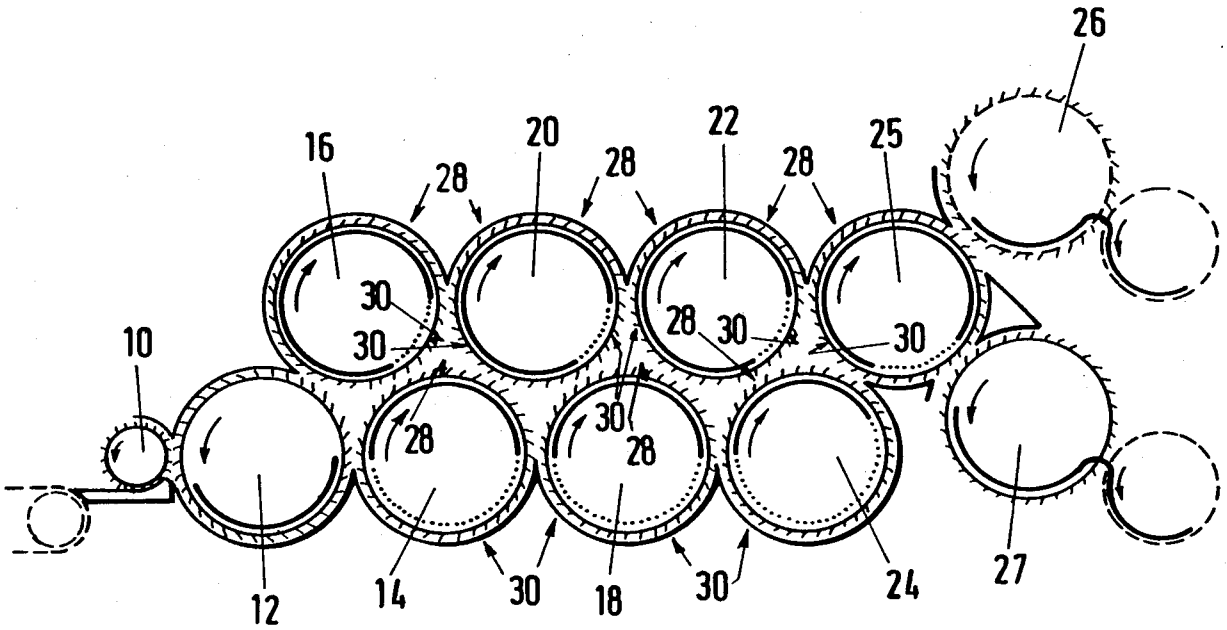

Further features and advantages of the invention derive from the following description in which exemplary embodiments are set forth in detail with reference to the drawing. Thereby shown are:

FIG. 1 an exemplary embodiment of a carder of the invention shown in a schematic section perpendicular to the rotational axis of the machine rollers or drums;

FIG. 2 another exemplary embodiment in a view corresponding to that of FIG. 1.

As FIG. 1 shows, the carder of the invention given the exemplary embodiment shown therein comprises a draw-in roll 10 which, under given conditions as in the carder of the species as well, can interact with a draw-in trough or the like; of course, a plurality of draw-in rolls or troughs can also be provided. The draw-in roll 10, which can run, for example, with a circumferential speed of 10 m/min, charges a licker-in 12 running in the same direction therewith whose circumferential speed can, for example, lie at about 300 m/min. The licker-in 12, which thus runs in the same direction as the draw-in roll 10 and whose surface, like the surface of the draw-in roll 10 as well the surfaces of all following rollers or drums in the illustrated exemplary embodiment, is provided with an appropriately fashioned sawtooth fitting, is followed by a first working roller 14 running in the opposite direction which in turn interacts with a second working roller 16 as well as with a third working roller 18. The second working roller 16 and the third working roller 18 charge a fourth working roller 20 which is in turn followed by a fifth working roller 22 as well as by a sixth working roller 24, whereby the fifth working roller 22 and the sixth working roller 24 are in turn followed in common by a seventh working roller 25. The working rollers 14,16,18,20,22,24 and 25 each have a circumferential speed of, for example, about 1400 m/min, whereby the relative speeds of the working rollers, just like their relative spacings, i.e. the width of the respective nip, are adjustable. In the way to be seen from the drawing, the working rollers 14,16,18,20,22,24,25 are followed by two doffing cylinders 26,27 which run in a direction opposite that of all working rollers running in the same direction, running with a circumferential speed of, for example, about 116 m/min.

The carder set forth to this extent with reference to FIG. 1 operates in the following way:

In a known way, the draw-in roll 10 conveys fibrous material onto the licker-in 12 in uniform feed. The first working roller 14 running, as shown, in the direction opposite thereto with considerable drawing, takes the fibrous material off from the licker-in 12 and cards it in a first step in cooperation with the second working roller 16 and with the third working roller 18. All of the fibrous material the first working roller 14 takes from the licker-in 12 is thereby not immediately transferred onto the second working roller 16 or, respectively, onto the third working roller 18; on the contrary, as may be seen from the drawing, only that portion present in a transfer region 28 is thusly transferred, whereas that portion of the fibrous material present in a storing region 30 is again returned one or more times and is subjected to a further carding. The same conditions also prevail between the further working rollers 20,22,24,25 which follow the working rollers 16, 18, whereby the amount of the portions of the respectively transferred and of the respectively returned fibrous material is adjustable by corresponding control of the relative spacings between the respective working rollers or, respectively, of the relative speeds thereof. As likewise provided in the apparatus of the species, finally, the doffing cylinder 26 which, of course, could also be replaced in a known way by a multiple roller haul-off or the like and which may also be connected with a crushing roller haul-off as set forth in the apparatus of the species, runs considerably slower than the working rollers, so that a relatively greatly "telescoped" formed fabric is pushed onto it. The formed fabric material that is obtained is uniform over the full working width of the machine and has a ratio of longitudinal strength to cross strength which amounts to about 1:1, as desired. The working cylinders of identical diameter can also be manufactured sag-free even given extremely large working widths of the machine. In addition to eliminating the problem of roller sag, abandoning worker and clearer rolls also guarantees a considerably simpler structural format.

In the exemplary embodiment shown in FIG. 2, two working rollers 14, 16 cooperate with the licker-in 12, these two working rollers being followed by further working rollers 18,20,22,24, and 25 in the way shown in the drawing, these being allocated such to one another overall that the fibrous material introduced by means of the draw-in roll 10 is forwarded or, respectively, returned by the individual working rollers to the desired degree, whereby, of course, the licker-in 12 does not participate in the return storing. The circimferential speeds of the draw-in roll 10, of the licker-in 12 running in the same direction therewith, as well as of the working rollers 12,14,16,20,22,24 and 25 running in the opposite direction, as well as of the doffing cylinders 26,27 may agree with the values recited in conjunction with FIG. 1. For the rest, the apparatus functions in the way set forth above with reference to the exemplary embodiment of FIG. 1.

The features of the invention disclosed in the above description, in the drawing, as well as in the claims can be essential for the realization of the invention in the various embodiments thereof, being potentially essential both individually as well as in arbitrary combinations.

We claim:

1. A method for the manufacture of a formed fabric from a fibrous material which comprises:

carding a web of said fibrous material by means of at least three working rollers running in the same direction whose spacings and relative speeds are adjustable with respect to one another, said rollers operating to card a portion of the fibrous web and storing the remainder for recycle.

2. A method according to claim 1, wherein each of said working rollers is capable of speed adjustment independently of the others.

3. A carder for the manufacture of formed fabric from fibrous material comprising:

at least one draw-in roller receiving said fibrous material, a licker-in roller running in the same direction as said draw-in roller, a first working roller following said licker-in roller, rotating in the opposite direction, but at a greater speed than said licker-in roller, at least second and third working rollers of the same diameter as said first roller running in the same direction and at a speed higher than that of said licker-in roller, a fourth working roller following said second and third working rollers, said first, second, third and fourth working rollers being adjustable in speed and in spacing with the other rollers to control the relative proportion of fibrous material passed to succeeding rollers and returned to preceding rollers, respectively.

4. A carder according to claim 3, wherein said first and second working rollers engage said licker-in roller.

5. A carder according to claim 3, wherein said first working roller and said second working roller are in engagement with each other.

6. A carder according to claim 3 which includes fifth and sixth working rollers following said fourth roller, and a doffing cylinder following the last working roller.

7. A carder according to claim 3, wherein said working rollers have sawtooth configurations thereon.

* * * * *